US010265562B2

(12) United States Patent
Woodman

(10) Patent No.: US 10,265,562 B2
(45) Date of Patent: Apr. 23, 2019

(54) SAFETY ENCLOSURE FOR TRAMPOLINE USERS

(71) Applicant: Plum Products Holdings Pty Ltd, Neutral Bay, New South Wales (AU)

(72) Inventor: David Woodman, Ingham (GB)

(73) Assignee: Plum Products Holdings Pty Ltd, Neutral Bay, New South Wales (AU)

( * ) Notice: Subject to any disclaimer, the term of this patent is extended or adjusted under 35 U.S.C. 154(b) by 0 days.

(21) Appl. No.: 15/597,089

(22) Filed: May 16, 2017

(65) Prior Publication Data

US 2017/0326399 A1 Nov. 16, 2017

(30) Foreign Application Priority Data

May 16, 2016 (GB) ..... 1608611.8

(51) Int. Cl.

| | |
|---|---|
| ***A63B 5/11*** | (2006.01) |
| ***A63B 21/02*** | (2006.01) |
| ***A63B 61/00*** | (2006.01) |
| ***A63B 71/00*** | (2006.01) |
| ***A63B 71/02*** | (2006.01) |

(52) U.S. Cl.

CPC ..... *A63B 5/11* (2013.01); *A63B 21/023* (2013.01); *A63B 71/0054* (2013.01); *A63B 71/022* (2013.01); *A63B 71/023* (2013.01); *A63B 61/003* (2013.01); *A63B 2071/0063* (2013.01); *A63B 2071/0072* (2013.01);

(Continued)

(58) Field of Classification Search

CPC ..... A63B 5/11; A63B 71/023; A63B 71/022; A63B 71/0054; A63B 21/023; A63B 2210/58; A63B 2071/0072; A63B 2225/093; A63B 61/003; A63B 2208/12; A63B 2071/0063

See application file for complete search history.

(56) References Cited

U.S. PATENT DOCUMENTS 3,734,496 A * 5/1973 Rubin ..... A63B 5/11 182/139
3,779,201 A * 12/1973 Spahn ..... B63B 1/047 280/206

(Continued)

FOREIGN PATENT DOCUMENTS

AU 2013-206387 A1 7/2013
CA 2820766 A1 12/2014

(Continued)

*Primary Examiner* — Garrett K Atkinson
(74) *Attorney, Agent, or Firm* — Rabin & Berdo, P.C.

(57) ABSTRACT

A trampoline comprising a trampoline mat defining a jumping area and supported via springs from a circumextending support structure, the support structure including a plurality of legs so that the trampoline mat is positioned at a height above ground or flooring; the trampoline being provided with a safety enclosure surrounding the jumping area. The safety enclosure comprises a net supported by a plurality of telescopically extendable poles, each pole when extended comprising a plurality of sections, each successive extended section with distance above the trampoline mat having a cross-section less than that that of the next less extended section whereby the sections nest when telescopically collapsed. The lowermost such section is supported at a position above the ground or flooring by the support structure.

3 Claims, 12 Drawing Sheets

(52) U.S. Cl.
CPC ..... *A63B 2208/12* (2013.01); *A63B 2210/58* (2013.01); *A63B 2225/093* (2013.01)

(56) References Cited

U.S. PATENT DOCUMENTS 4,037,835 A * 7/1977 Forsyth ..... A63B 5/11 248/346.5
5,385,518 A * 1/1995 Turner ..... A63B 5/11 482/23
5,637,057 A * 6/1997 Collura ..... A63B 5/11 482/27
5,810,695 A * 9/1998 Sass ..... A63B 5/11 441/37
6,053,845 A * 4/2000 Publicover ..... A63B 5/11 482/27
6,447,426 B2 * 9/2002 Peterson ..... A63B 5/11 114/311
6,508,682 B1 * 1/2003 Clark ..... B63B 7/08 441/131
7,220,218 B1 5/2007 Chu
7,762,927 B1 7/2010 Gordon
7,833,132 B2 * 11/2010 Hylbert ..... A63B 5/11 482/27
8,790,221 B2 * 7/2014 Schaffer ..... A63B 5/11 482/23
2002/0137598 A1 * 9/2002 Publicover ..... A63B 5/11 482/27
2003/0064861 A1 * 4/2003 Chen ..... A63B 5/11 482/27
2004/0107491 A1 * 6/2004 Publicover ..... E04H 4/0018 4/498
2006/0128529 A1 6/2006 Adams
2009/0181827 A1 * 7/2009 Hylbert ..... A63B 5/11 482/29
2009/0260148 A1 * 10/2009 Chen ..... E04H 4/0025 4/506
2009/0264042 A1 * 10/2009 Chen ..... A63G 31/12 446/221
2010/0035730 A1 * 2/2010 Dukart ..... A63B 5/11 482/27
2010/0229296 A1 * 9/2010 Samuel ..... E04H 4/0025 4/506

FOREIGN PATENT DOCUMENTS

CN 202096648 U 1/2012
CN 205780111 U 12/2016
GB 2441662 A 3/2008
GB 2454029 A 4/2009
WO WO 98-58706 A1 12/1998
WO WO 2015-074097 A1 5/2015

* cited by examiner

SAFETY ENCLOSURE FOR TRAMPOLINE USERS

BACKGROUND

This disclosure relates to the fitting of enclosures to trampolines to provide a measure of safety to users of the trampoline.

Trampolines are popular garden play equipment and are provided in various shapes and sizes. They comprise a trampoline mat supported from a support structure, usually by a plurality of springs. In the interests of safety for users of the trampoline, and to reduce the likelihood that a user could fall off the trampoline mat while using the trampoline, a circumextending safety enclosure is commonly provided. This generally comprises a flexible net supported from a plurality of poles upstanding above the trampoline mat and mounted to the support structure for the sheet.

These safety enclosures are typically as much as two metres in height, and since the trampoline mat will also be mounted on the support structure at a height of as much as one metre, the overall structure is tall and unsightly. In addition, assembly and mounting of an enclosure to the trampoline is time-consuming. Errors in assembly by a user on site may result in a structure that will fail to live up to its safety intentions. To allow a user to get inside the enclosure to use the trampoline, an opening of some form is required through the net, which will weaken the ability of the net to restrain a user within the enclosure. High winds are likely to damage tall netting structures. Gusts of wind in the netting may even cause the whole trampoline to be moved or overturned.

While covers are available for covering a trampoline without its enclosure for protection during the winter months, users typically find that dismantling the enclosure from the trampoline is too much bother, with the result that covers, even when available, are often not used. This leaves the trampoline mat, and sometimes also the springs exposed, as well as the supporting structure. As a result, the trampoline mat and springs (or an annular pad overlying the springs) may be exposed which will result in additional wear and tear due to weather.

While all of these problems are well understood by trampoline manufacturers, heretofore, they have not been sufficiently addressed.

SUMMARY OF THE DISCLOSURE

The present disclosure results from Applicant's work seeking to provide improved safety enclosures for trampolines which ameliorate or overcome these problems and allow for easier and faster and more reliable mounting of the enclosure on and demounting of the enclosures from a trampoline.

According to one aspect of this disclosure, there is provided a trampoline comprising a trampoline mat defining a jumping area and supported via springs from a circumextending support structure, the support structure including a plurality of legs so that the trampoline mat is positioned at a height above ground or flooring; the trampoline being provided with a safety enclosure surrounding the jumping area and comprising a net supported by a plurality of telescopically extendable poles, each pole when extended comprising a plurality of sections, each successive extended section with distance above the trampoline mat having a cross-section less than that that of the next less extended section whereby the sections nest when telescopically collapsed, and the lowermost such section being supported at a position above the ground or flooring by the support structure.

Preferred embodiments of the above trampoline enclosure have one or more of the following features: The number of sections is three. Preferably, the distal end of the most extended section is provided with a connector for connecting to the net. Each connector allows a limited range of movement of the net relative to the poles. At least some of the legs of the support structure are hollow tubes, and the lowermost section of each telescopically extendable pole is mounted in a said hollow tube, preferably being telescopically retractable therewithin. In an alternative arrangement, each telescopically extendable pole has a corresponding bracket, the bracket having a circumference large enough that the lowermost section may fit closely within it, and preferably so that the said lowermost section may slide through the bracket, and the bracket being mounted on the support structure. The bracket is a collar. In a preferred arrangement, the support structure comprises a plurality of support sections, male ends of which fit in female sockets defined by hollow crossbars of generally T-shaped couplers whereby the support sections and couplers together form a circumextending structure, hollow uprights of the generally T-shaped couplers serving as female sockets for the legs, and each said bracket being integral with a said coupler and extending parallel to the coupler upright.

In a second aspect of this disclosure, we provide a method for assembling a safety enclosure with a trampoline, the trampoline comprising a trampoline mat defining a jumping area and supported via springs from a circumextending support structure at a position above the ground or flooring, the method comprising the steps of: mounting proximal ends of a plurality of telescopically extendable poles to the support structure, and extending the poles telescopically so that distal ends thereof are located above the support structure; and, either before or after extending the poles, mounting a safety net having first and second circumferentially extending edges so that the first edge is coupled to the said distal ends of the poles, and the second edge is coupled either to the support structure or to the edge of the trampoline mat inboard of the support structure.

Preferably the net mounting step is performed before extending the poles, and the net is stretched tight when the poles are fully extended. The net may be provided with a suitable entrance/exit through which a person may pass when the poles and net have been raised to their full extent. Alternatively, the net could be continuous without any opening for passage of trampoline users therethrough, users of the trampoline being required to mount the trampoline and stand on the jumping area before the poles are extended to their full extent.

When the net is coupled to the poles before extension, the telescopic poles are preferably extended or retracted in unison, or alternatively, one telescopic section per pole for all poles before extension or collapse of the next section.

BRIEF DESCRIPTION OF THE DRAWINGS

Preferred embodiments of trampoline in accordance with our teachings are described hereinbelow by way of example only with reference to the accompanying drawings in which.

DETAILED DESCRIPTION

Figure 1:
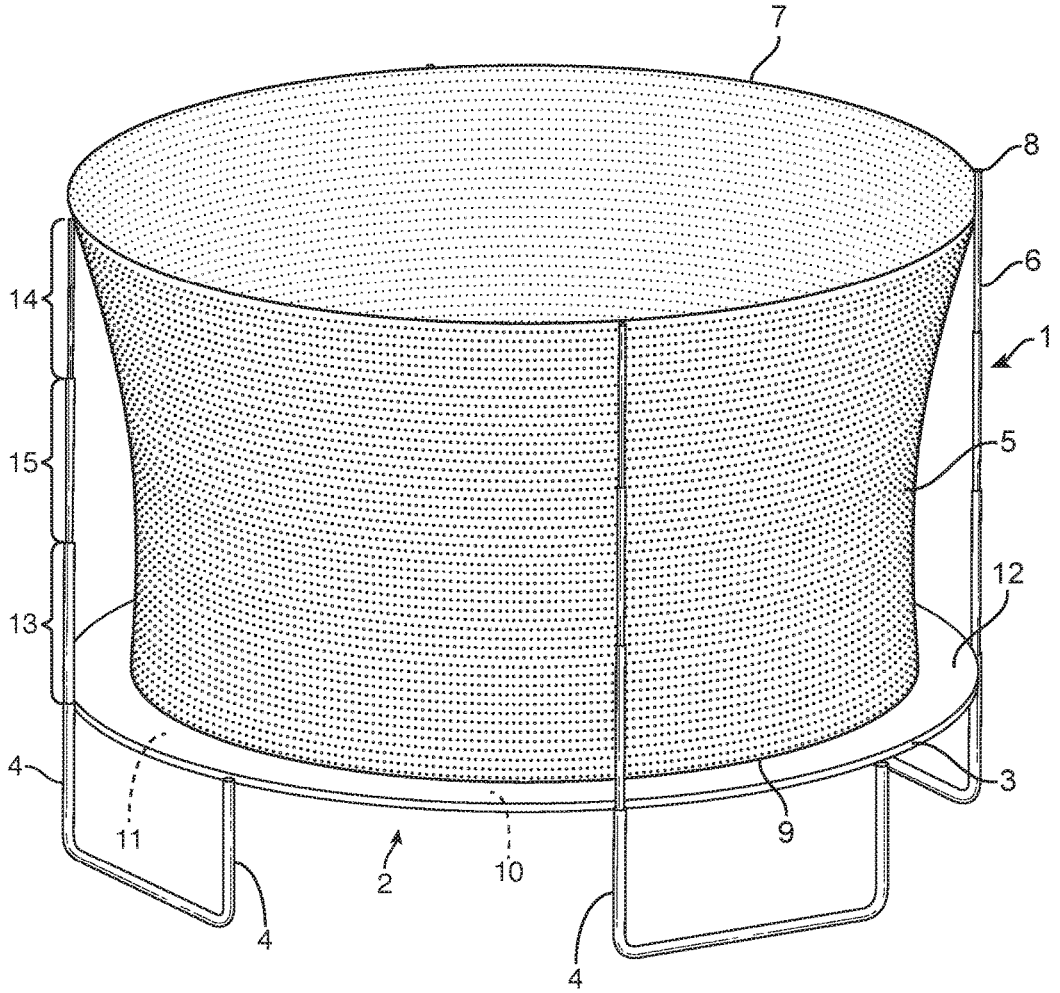
FIG. 1 is a perspective view of a trampoline with a trampoline enclosure with telescopic poles in their fully extended position.

Referring first to FIG. 1, there is shown a trampoline safety enclosure 1 mounted to a trampoline 2. Circumextending support structure 3 is held at a position above the ground by a plurality of legs 4. A generally circumextending net 5, is supported by a plurality of telescopic poles 6, shown in their fully extended state, the net having a first generally circumferentially extending edge 7 coupled to distal ends 8 of the poles 6, and a second generally circumferentially extending edge 9 coupled to the edge of a trampoline mat 10 (best shown in FIG. 4) suitably mounted by a plurality of springs 11 to the support structure 3 beneath an annular pad 12. The net may have an opening or doorway therethrough for users to reach a jumping area defined by the trampoline mat. Alternatively, the net could be continuous without any opening or doorway therethrough for users to reach a jumping area defined by the trampoline mat. With the poles in their fully extended condition, as shown in FIG. 1, the net is stretched tight. It will be understood that, while each pole in the arrangement of FIGS. 1 to 4 has three sections, a greater or lesser number of telescopically nesting sections may be employed. However, we have found that for practical purposes, having precisely three sections gives the best compromise between strength and size when collapsed.

Figure 5:
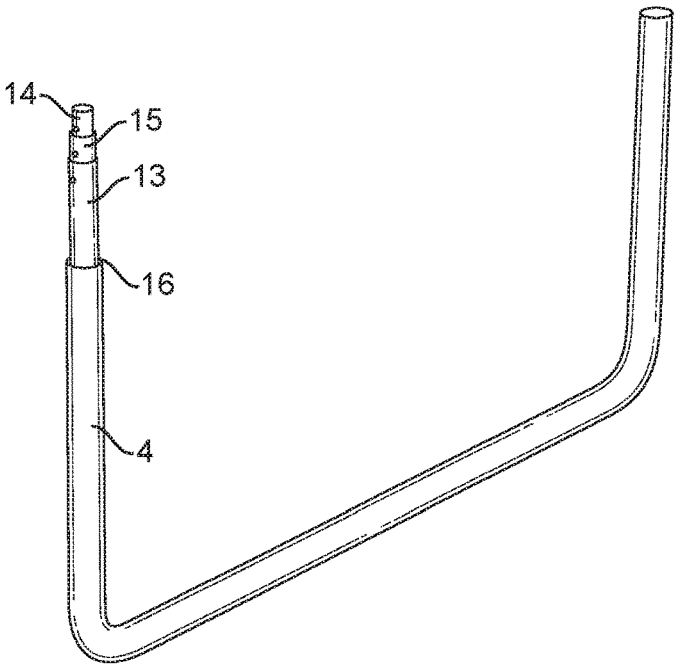
FIG. 5 is a view of a telescopic pole mounted within a hollow leg of the trampoline.
Figure 6:
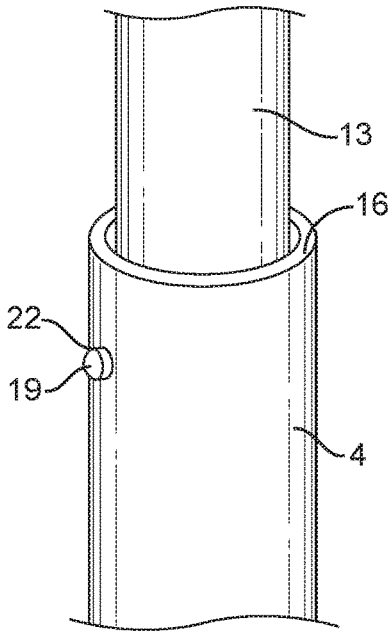
FIG. 6 is a closer view of the telescopic pole and leg of FIG. 5, showing how they are coupled together.

In this embodiment, the largest nesting section (the nesting section with the largest cross-section) is lowermost section 13. The smallest nesting section (the nesting section with the smallest cross-section) is uppermost section 14. One nesting section, intermediate section 15, is provided between the sections 13 and 14. Section 15 has a smaller cross-section than section 13, and a larger cross-section than section 14. Section 14 fits telescopically within section 15 which fits telescopically within section 13. Section 13 fits within hollow end 16 of a leg 4, as shown in FIGS. 5 and 6.

Figure 2:
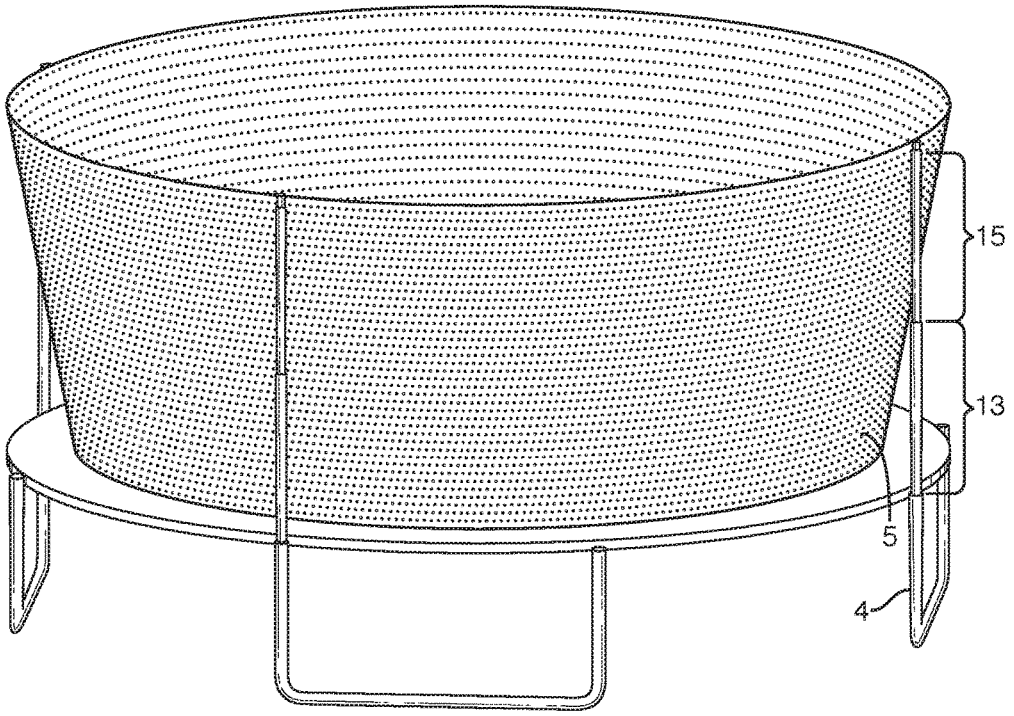
FIG. 2 is a view similar to FIG. 1, with the smallest (uppermost) section of each pole in its retracted position, and lower sections in their extended position.
Figure 3:
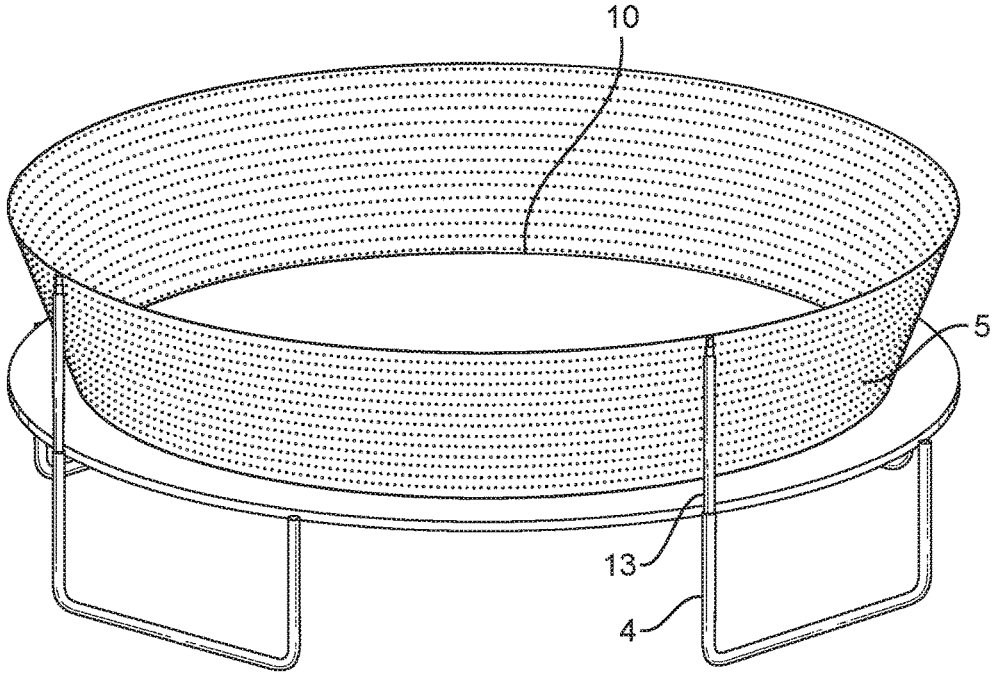
FIG. 3 is a view similar to FIGS. 1 and 2, with the smallest two sections of each pole in their retracted positions.
Figure 4:
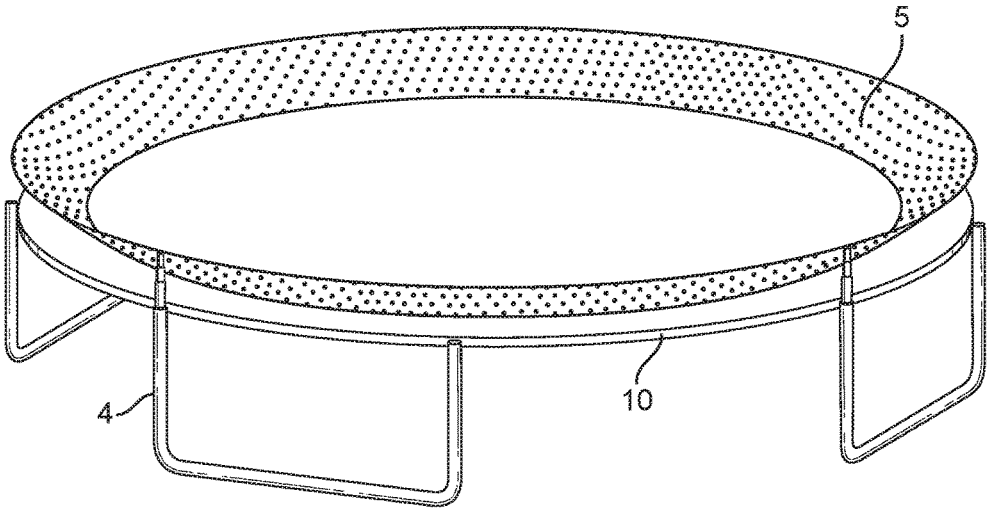
FIG. 4 is a view similar to those of FIGS. 1, 2 and 3, with each telescopic pole fully retracted.

FIGS. 2, 3, and 4 show the trampoline of FIG. 1, but with the telescopic poles in different positions. In FIG. 2, the smallest (uppermost) sections 14 have all been retracted into their retracted positions, and have fitted telescopically within their corresponding sections 15. Accordingly, the net is held at a lower position than as shown in FIG. 1. In FIG. 3, smallest (uppermost) section 14 and section 15 have both been retracted into their retracted positions, and have fitted telescopically within section 13. Accordingly, the net is held at a lower position than as shown in either FIG. 1 or FIG. 2.

In FIG. 4, sections 13, 15, and 14 have all been retracted into their retracted positions, and are telescopically retracted within the hollow leg 4. In this arrangement, when the poles 6 are fully retracted within respective legs 4, they are substantially hidden from view. Retracting the poles is simple, safe, and fast, so that within a few minutes of the enclosure no longer being required, the poles can be stowed largely out of sight. In this stowed (retracted) position a trampoline cover may be placed over the trampoline as a whole. In the collapsed state, the net is protected from wind gusts. Since the poles remain in position, the trampoline enclosure may be readily resurrected. Users also have the possibility of removing the net from the poles during a longer period during which the equipment will not be used, or of removing the poles as well. In some arrangements, the telescopic pole as a whole may be removed from the leg 4.

The progression shown in FIGS. 1-4 represents Applicant's preferred manner of collapsing the trampoline enclosure. Namely: the most distal, smallest cross-section pole section 14 is retracted for each pole either simultaneously, or one pole at a time, followed by the next smallest cross-sectioned pole sections 15, and so on. Re-erection follows the reverse order of steps. It is not essential to have an opening or doorway through the net, since a user could step over the collapsed net in the configuration of FIG. 4, and the net could be raised around them by the user or by others. To leave the trampoline, the net could simply be lowered by collapsing the telescopic poles. Nevertheless, it is still our preference to provide a suitable entrance/exit through which a person may pass when the poles and the net are extended to their full extent.

For reasons which will become apparent shortly, in preferred arrangements, the pole sections have a cross-section other than that of a simple circle, to prevent relative rotation. In order that the poles 6 can fit within the hollow ends 16 of the legs, even the largest cross-section pole section must have a cross-section less than that of legs 4. Sections successively further from the leg must each fit in the next larger cross-section section and so the cross-sections become progressively smaller with distance from the legs 4. For the most distal section to support the net 5, it must still be sufficiently rigid despite its smallest cross-section. For this reason, we prefer no more than three sections for each leg, with the smallest cross-section pole section 14 having a diameter of 26 mm. We have found that mild steel with a thickness of 1.2 mm is a suitably strong yet light material for the pole section. Since the telescopically collapsed sections each have similar lengths and all have to be accommodated within the leg 4, having just two sections would not provide sufficient height for the enclosure when the pole is fully expanded.

FIG. 5 shows a closer view of one leg 4 and one pole 6 of trampoline 2. In FIG. 5, sections 15 and 14 are in their fully retracted positions, and therefore are telescopically positioned within section 13. Section 13 is partially extended from within leg 4.

Figure 7:
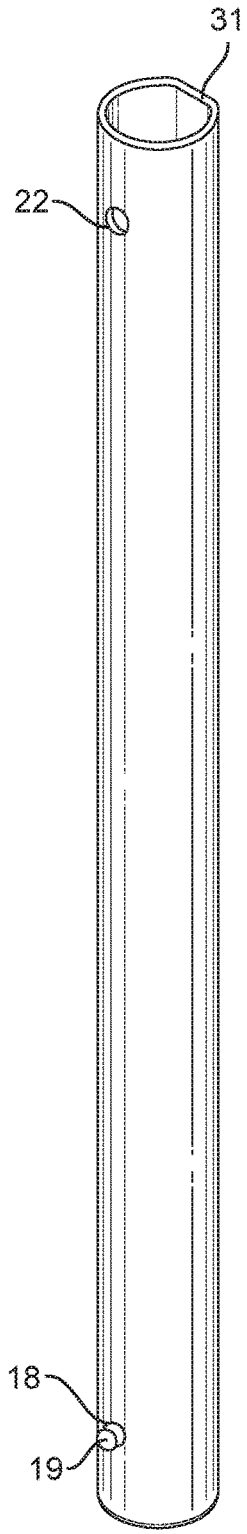
FIG. 7 is a perspective view of one nesting section of a telescopic pole.
Figure 8:
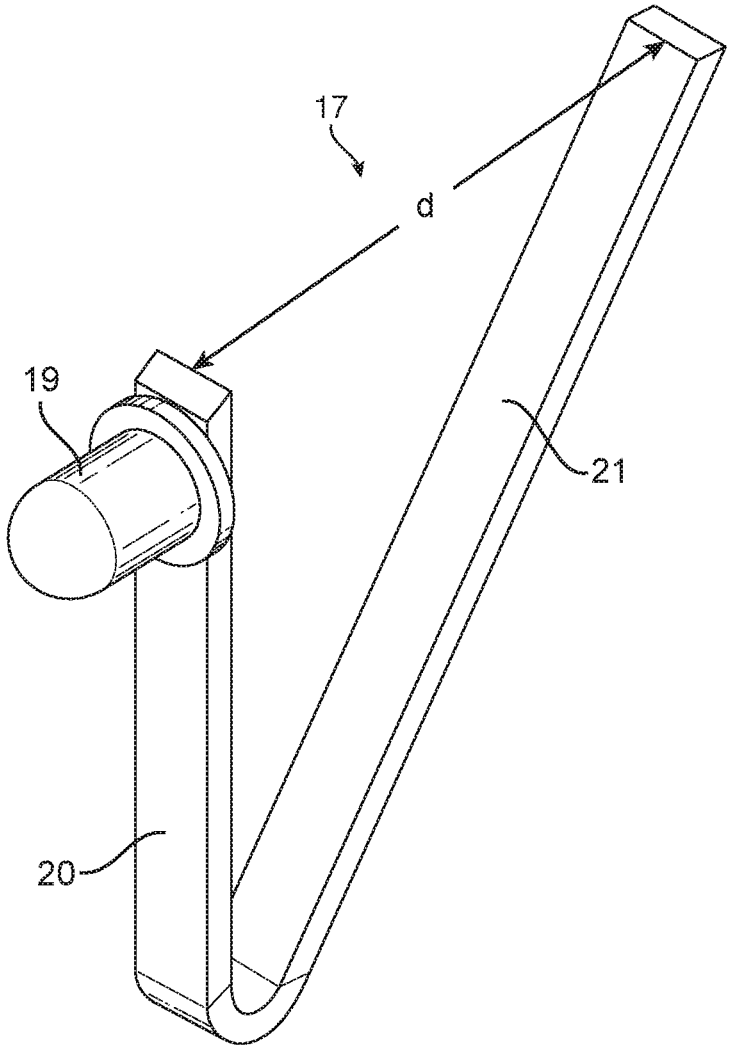
FIG. 8 is a perspective view of a spring coupling allowing locking of sections together in extended positions and for coupling a pole to a leg.

FIGS. 6, 7, and 8 show an exemplary spring coupling 17 for locking sections of a pole together or for mounting the lowermost pole section 13 in fixed relation to a leg 4. Those familiar with telescopic struts in other fields (for example in extendable handles for pulling wheeled luggage) will be familiar with the use of such spring couplings for selectively locking sections together. One component (here: the pole section 13 in FIG. 6) has a through hole 18 (FIG. 7), with a protruding button 19, mounted on one end of a first arm 20 of the spring coupling 17, which is fixedly mounted within that that component. As can be seen, the spring coupling 17 is generally V-shaped with two arms 20, 21. The distance "d" between the ends of the two arms is greater than the internal width of pole section 13 where the spring coupling is mounted so that the button 19 is biased to extend through hole 18 to be received in a second hole 22 of the other component (here leg 4). To ensure that button 19 is received in hole 22, the pole sections should be incapable of rotating relative to each other or to the leg 4. This is readily achieved by including a flat on one side of each pole section and of the leg, as further explained with reference to FIG. 11 and the alternative bracket mount arrangement illustrated in that Figure and in FIGS. 9 and 10.

Figure 9:
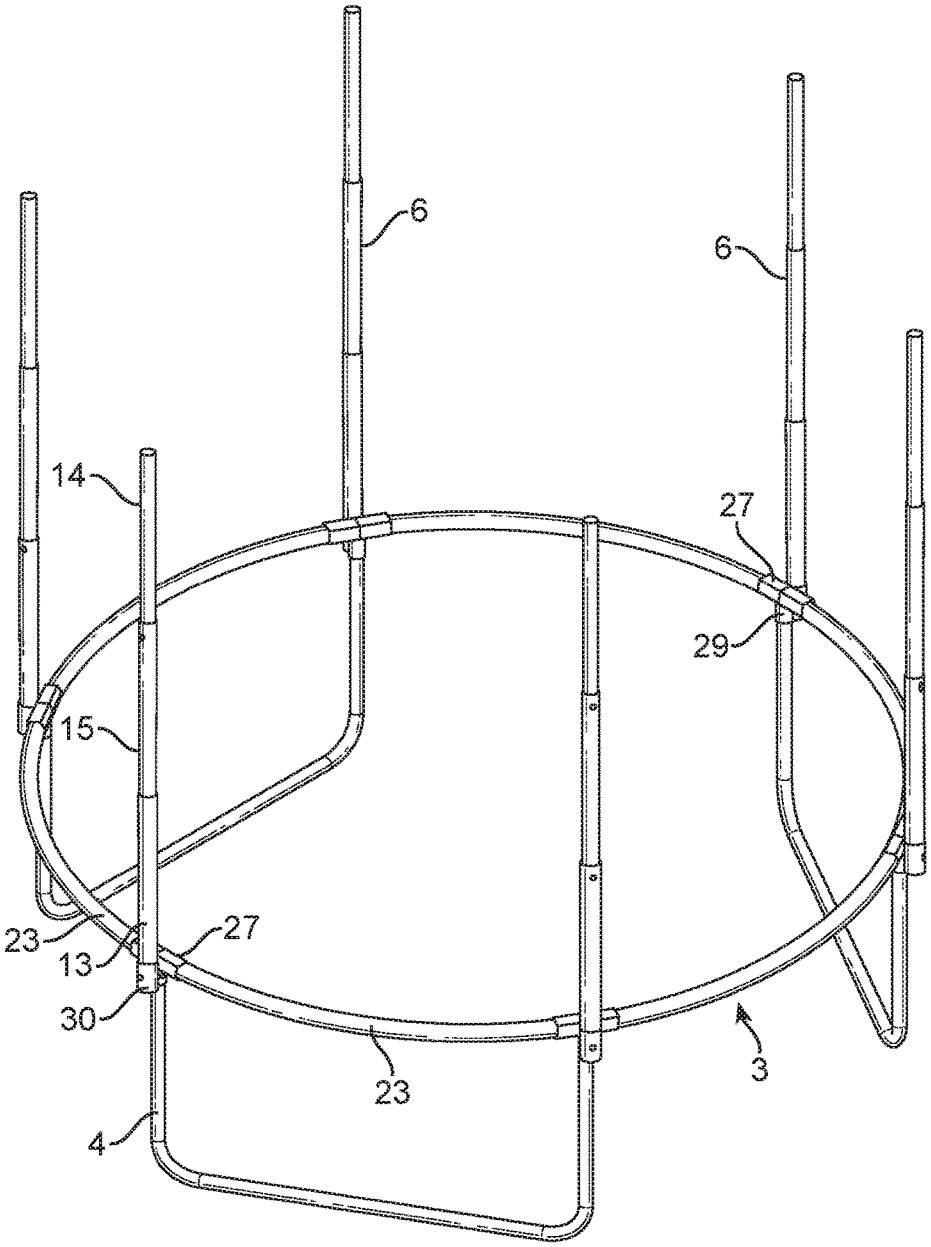
FIG. 9 is a view of a support structure and telescopic poles for an alternative embodiment of trampoline, the trampoline mat, trampoline springs and superposed annular pad and the safety net all being omitted for clarity.
Figure 10:
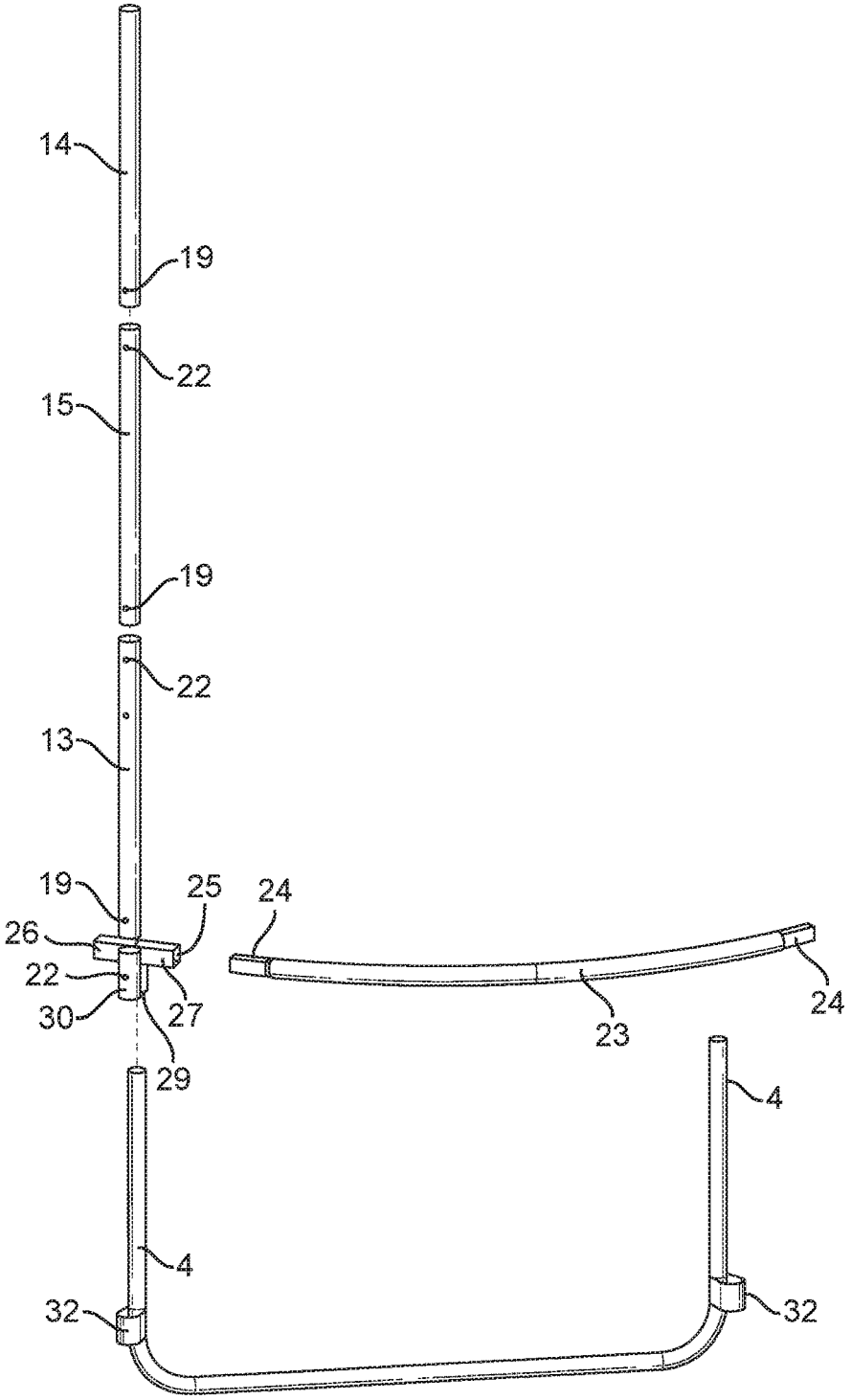
FIG. 10 is an exploded view of parts of the embodiment of FIG. 9.
Figure 11:
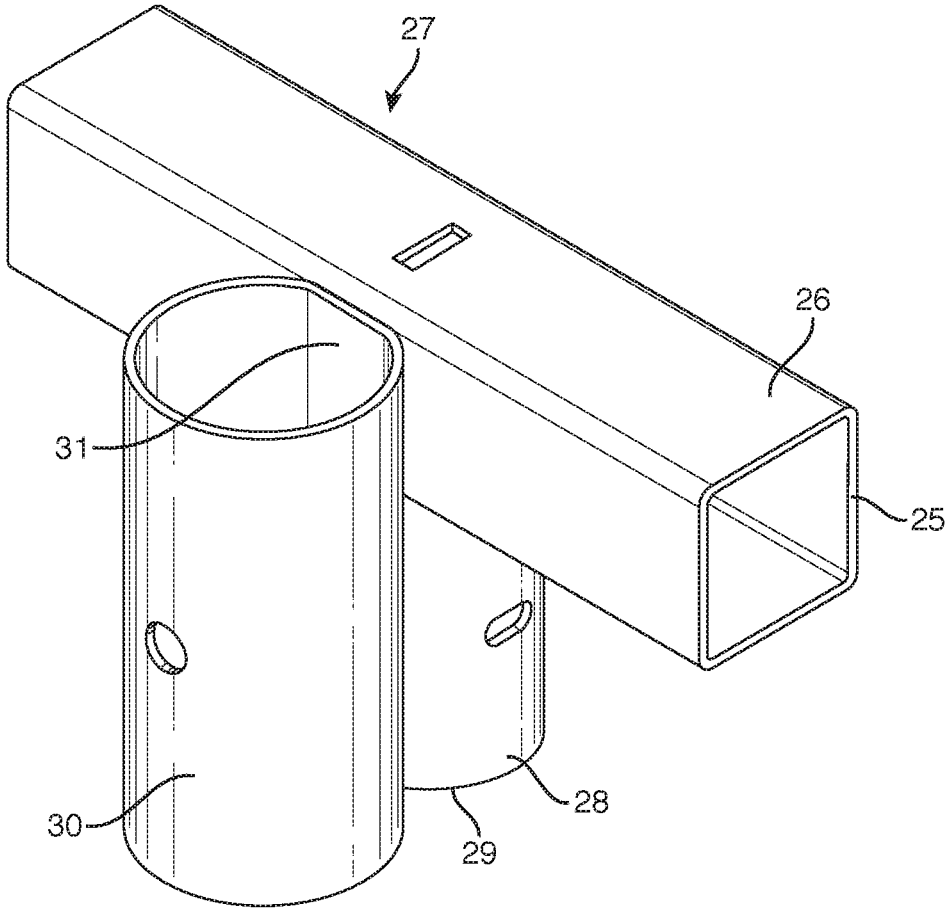
FIG. 11 is an enlarged perspective view of a coupler shown in FIGS. 9 and 10.

Turning now to FIGS. 9, 10 and 11, which shows the aforesaid alternative arrangement. Here, the circumextending support structure 3 comprises a plurality of support sections 23, male ends 24 of which fit in female sockets 25 defined by hollow crossbars 26 of generally T-shaped couplers 27, whereby the support sections 23 and couplers 27 together form a circumextending structure, hollow uprights 28 of the generally T-shaped couplers 27 serving as female sockets 29 for the legs 4. As best shown in FIG. 11, a bracket 30 is integral with coupler 27, as by being welded thereto, and extending parallel to the coupler upright 28.

As shown in FIGS. 9 and 10, the lowermost section 13 of each telescopic pole 6 is received within bracket 30. The bracket has a cylindrical form apart from a flat 31 along one side. The pole sections take a similar (although smaller) form, which prevents relative rotation and ensures that holes 18 and 22 van be brought into alignment so that respective components may be releasably locked together (it being appreciated that a lock may be released by pushing the button sufficiently inwardly against its bias to free it from the respective hole 22.

This arrangement contemplates a first possibility of fitting lowermost section 13 to bracket 30 so that the lower end of the pole is held in a single position, but may be released from the bracket to allow the pole as a whole to be removed, and a second possibility in which the pole is slidably received in the bracket, having a first position in which a button 19 of spring coupling 17 extending through hole 18 adjacent one end of the pole section is received in a through hole 22 of the bracket so that the telescopic pole as a whole extends above the bracket, and a second position in which the greater part of lowermost pole section 13 is pushed through and below bracket 30 and the bottom end of pole section 13 is received by a second bracket 32 is provided adjacent the foot of leg 4.

We prefer this arrangement, because trampoline legs are commonly formed with a U-shaped configuration, as shown in FIG. 10, with two straight upright portions 33 being joined by a bight portion 34 with extends along the ground or flooring, and the length of individual pole sections is no longer limited by the straight length of each such upright portion within which the lowermost leg section is received. Moreover, as shown in FIG. 11, the cross-section of the bracket 30 can be made greater than that of upright 28 of coupler 27 so that the cross-sections of the pole sections can be larger than when the lowermost pole section has to fit within a leg 4.

Figure 12:
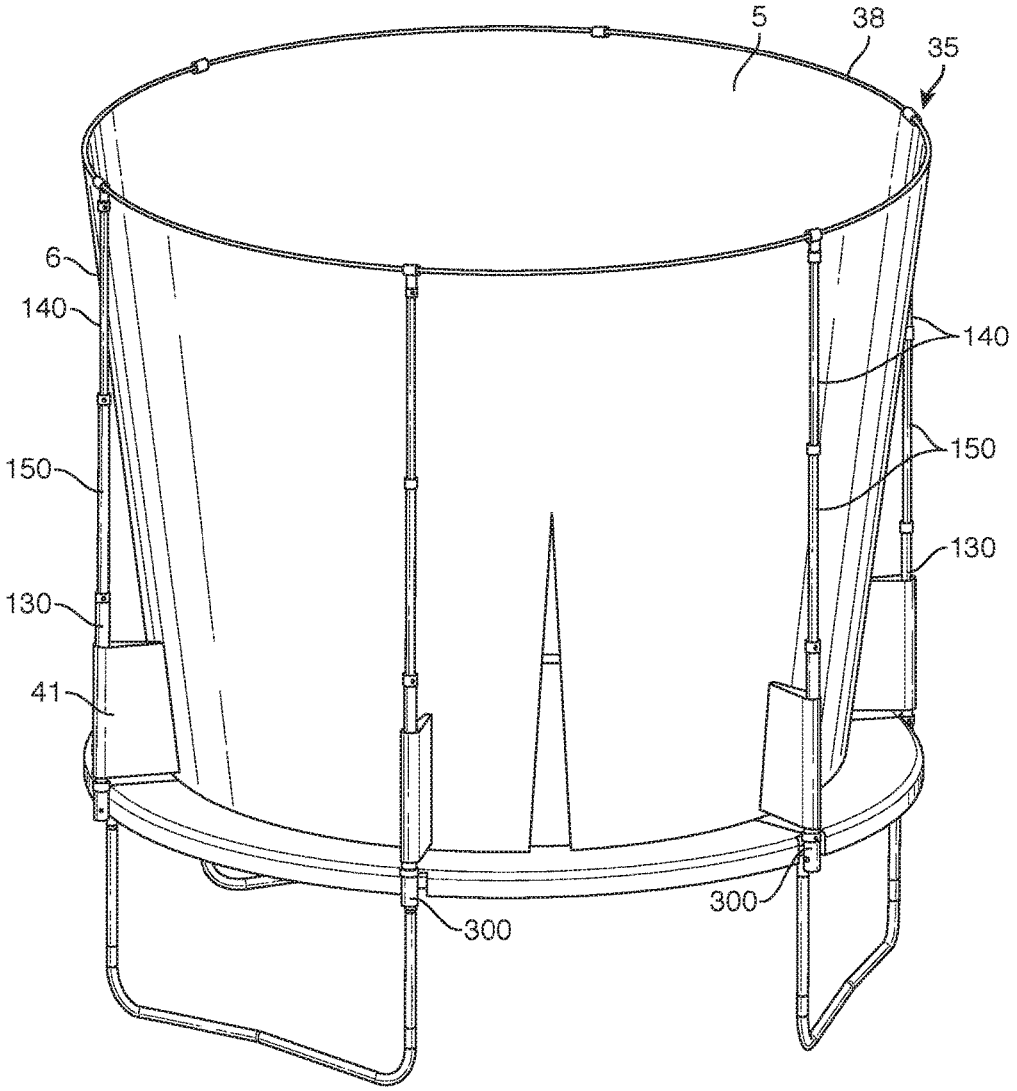
FIG. 12 is a perspective view of a trampoline with a trampoline enclosure with rectangular cross-sectioned telescopic poles in their fully extended position.

FIG. 12 shows an embodiment of a trampoline similar to the embodiment shown in FIGS. 9-11, the main difference being that pole section 130 (lowermost pole section, with the largest cross-section), pole section 140 (uppermost pole section, with the smallest cross-section), pole section 150 (intermediate pole section, which is provided between the sections 130 and 140, and which has a smaller cross-section than section 130, and a larger cross-section than section 140), and bracket 300, all have a cross-section which does not just have a single flat such as flat 31 in FIG. 7, but has a rectangular cross-section. Other than the shape of cross-section of the poles, the pole sections 130, 140, 150, in conjunction with bracket 300, telescope in the same manner as pole sections 13, 14, 15, in conjunction with bracket 30 (as in FIGS. 9-11). The exemplary spring coupling as described in relation to FIGS. 6, 7, and 8 may be used with rectangular cross-sectioned poles 130, 140, 150 (or indeed, with any cross section of pole that has at least one flat face in order to prevent rotation of the poles.

Figure 13:
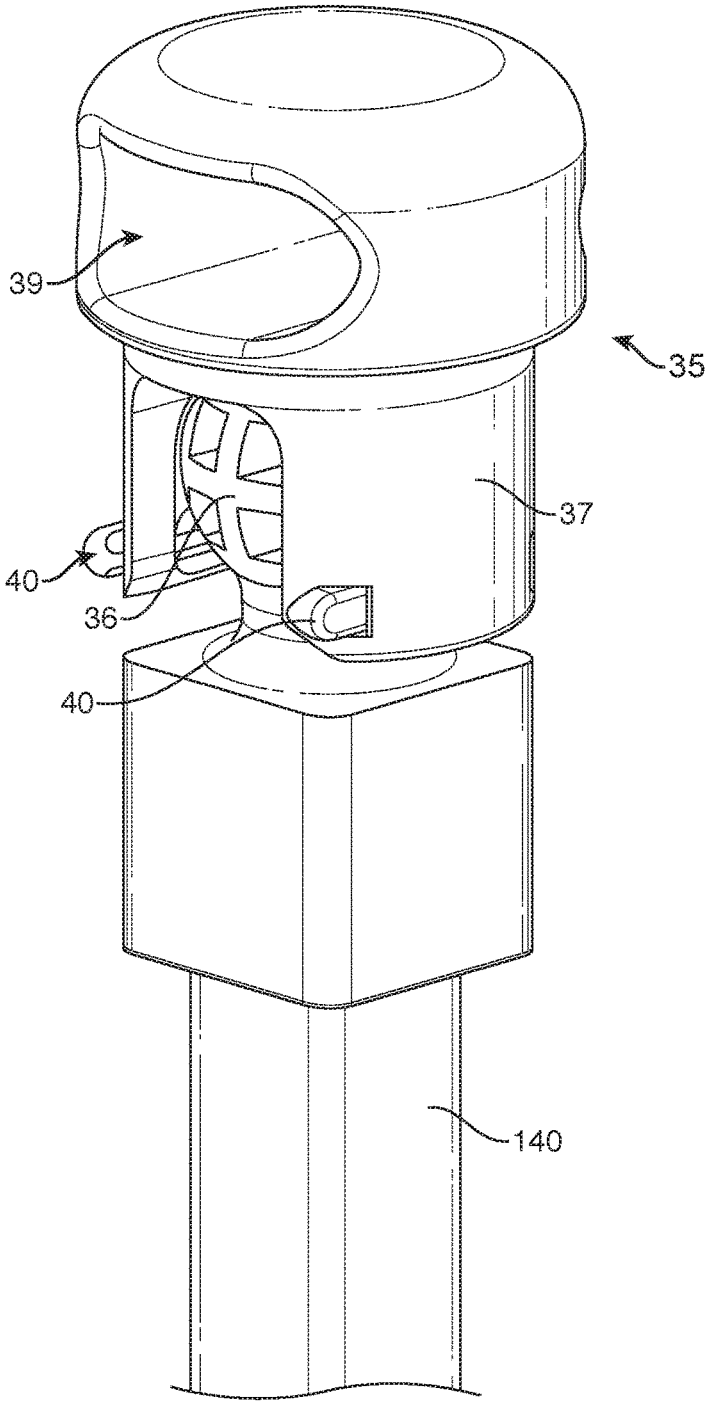
FIG. 13 is an enlarged perspective view of the connector shown in FIG. 12.

FIGS. 12 and 13 show one connector 35 that is used to connect the net 5 to the smallest cross-section pole section 14. Connector 35 is a ball joint including a ball portion 36, which is integrally formed with pole section 14, and a cage portion 37, to which net 5 can be attached. In FIG. 12, Net 5 is suspended by a circumextending frame 38, and cage portion 35 has a passage 39 through which circumextending frame 38 passes. Cage portion 37 is removable from ball portion 36, and reattachable to ball portion 36, by depressing catches 40. Connecting net 5 to poles 6 by a ball joint allows the net 5, and the frame 38 when present, to move relative to the poles, resulting in less stress on the net 5 when the poles 6 are not extended or retracted completely in unison.

FIG. 12 shows one way in way in which the net 5 may be attached to poles 6. As depicted, net 5 has a plurality of sheaths 41, which are passed around lowermost pole sections 13. It will readily be appreciated that alternative methods of attaching net 5 to poles 6 would be suitable.

What is claimed is:

1. A method for assembling a safety enclosure with a trampoline, the trampoline comprising a trampoline mat defining a jumping area and supported via springs from a circumextending support structure at a position above the ground or flooring, the method comprising the steps of:

mounting proximal ends of a plurality of telescopically extendable poles to the support structure;

extending the poles telescopically so that distal ends thereof are located above the support structure; and, before extending the poles, mounting a safety net having first and second circumferentially extending edges so that the first edge is coupled to the said distal ends of the poles, and the second edge is coupled either to the support structure or to the edge of the trampoline mat inboard of the support structure, so that the safety net is stretched tight when the poles are fully extended.

2. A method for assembling a safety enclosure with a trampoline according to claim 1, wherein the telescopic poles are extended or retracted in unison.

3. A method for assembling a safety enclosure with a trampoline according to claim 1, wherein one telescopic section per pole is extended or retracted for all poles before extension or collapse of the next section.

* * * * *